US006367754B1

(12) United States Patent
Cinker

(10) Patent No.: US 6,367,754 B1
(45) Date of Patent: Apr. 9, 2002

(54) SUPPORT FOR USE ON SPACED UPRIGHT MEMBERS

(76) Inventor: Ted Cinker, 10709 Westview Ave., Meadville, PA (US) 16335

( * ) Notice: Subject to any disclaimer, the term of this patent is extended or adjusted under 35 U.S.C. 154(b) by 0 days.

(21) Appl. No.: 09/479,794

(22) Filed: Jan. 8, 2000

(51) Int. Cl.[7] ..... B65H 49/00

(52) U.S. Cl. ..... 248/228.1; 242/129; 182/82; 248/217.1; 248/218.4

(58) Field of Search ..... 242/129, 134, 242/139, 594, 597.4, 597.8, 597; 248/217.1, 218.4, 219.3, 228.1, 246, 309.2, 214, 223.31; 182/82; 52/DIG. 1, 749.1

(56) References Cited

U.S. PATENT DOCUMENTS

| | | | | | |
|---|---|---|---|---|---|
| 141,498 | A | * | 8/1873 | Edmonston | 248/246 |
| 3,105,654 | A | | 10/1963 | Czapla | 242/423.1 |
| 3,319,906 | A | | 5/1967 | Atkinson | 242/592 |
| 3,837,597 | A | | 9/1974 | Bourhenne | 242/129 |
| 4,015,809 | A | * | 4/1977 | Buril | 248/217.2 |
| 4,167,255 | A | | 9/1979 | Benson | 242/129 |
| 4,214,718 | A | | 7/1980 | Silkey | 242/129.6 |
| 4,372,425 | A | * | 2/1983 | Murphy | 182/179 |
| 4,771,972 | A | | 9/1988 | Shaw | 248/217.2 |
| 4,909,350 | A | * | 3/1990 | Jacobs | 182/82 |
| 5,303,891 | A | * | 4/1994 | Powers | 248/218.4 |
| 5,348,241 | A | | 9/1994 | Huette | 242/597.5 |
| 5,535,974 | A | * | 7/1996 | Savitskiq | 248/246 |
| 5,690,301 | A | | 11/1997 | Shelton et al. | 242/597.8 |
| 6,098,552 | A | * | 8/2000 | Gunderson | 108/108 |
| 6,199,786 | B1 | * | 3/2001 | Lessard et al. | 242/406 |

* cited by examiner

*Primary Examiner*—Anita King
*Assistant Examiner*—Jon Szumny
(74) *Attorney, Agent, or Firm*—Alfred J. Mangels

(57) ABSTRACT

A support for supporting items from an open stud wall or from an A-frame step ladder. The support includes a pair of spaced, parallel crossbars, and a support arm that interconnects the crossbar substantially at their centers and extends outwardly therefrom to define a supporting surface for supporting one or more spools of electrical wire, for convenient unreeling of household wiring during home construction. Various forms of adapters can be provided to permit unreeling wire from a spool supported for rotation about a vertical axis or horizontal axis, and for supporting other items such as tools, workbench surfaces, drawing tables, and the like. The support is of simple form, is easy to use, and is versatile to adapt to different wall and ladder sizes.

22 Claims, 9 Drawing Sheets

SUPPORT FOR USE ON SPACED UPRIGHT MEMBERS

BACKGROUND OF THE INVENTION

1. Field of the Invention

The present invention relates to a support that can be releasably carried by a pair of substantially upright members for supporting a variety of items from the upright members. More particularly, the present invention relates to an improved support that is of relatively simple construction and that can be quickly and easily applied to a pair of laterally-spaced upright members, such as a pair of adjacent studs forming part of a stud wall or the rails of a ladder, for supporting objects such as spools of electrical wire from the upright members.

2. Description of the Related Art

In the course of constructing buildings, or carrying out building structural remodeling projects, it often becomes necessary to install electrical wiring within the walls of the structure. The wiring is provided in relatively large reels or spools containing from about 250 feet to about 1000 feet of wire, depending upon the size of the wire and its intended use. The provision of wiring in spool form requires that the wiring be uncoiled from the spool so it can be threaded through apertures provided in the studs that define framing members for walls before the walls are finished by the application of wallboard or the like. The wire spool is often placed on end on the floor and wire is uncoiled from it as needed for threading through the wall studs. That procedure, however, is a cumbersome one in that the spool does not rotate readily, particularly when it is full of wire and quite heavy. And unless the spool can be rotated, the wire as it uncoils from the spool becomes twisted, which is undesirable.

Various types of devices, sometimes referred to commercially as "wire caddies,"have been developed to enable more convenient uncoiling of wire from a spool at a construction site. Some of the wire caddies are frames having wheels and on which a spool of wire can be mounted to facilitate uncoiling of the wire. However, such wire caddies normally occupy floor space, and during construction or remodeling projects floor space is generally quite limited and oftentimes is occupied by other materials such as lumber, tools, tool boxes, ductwork, wall sheeting, and the like. Thus, there is a need for a support for supporting a wire spool off the floor for more convenient uncoiling of the wire.

One approach to the problem of supporting a spool of wire above the floor for easy uncoiling is disclosed in U.S. Pat. No. 3,837,597, entitled "Coiled Cable Dispenser,"which issued on Sep. 24, 1974, to Bourhenne. A rotatable circular table is disposed horizontally to support a spool or a coil of wire and that includes a wire guide loop to guide the wire as it is unwound from the spool. The rotatable table is supported from an arm that is attached to a single, vertically extending stud. The arm can be moved up and down along the stud to the wire spool to be positioned at a desired height above the floor for convenient access.

An only slightly different form of support for a wire spool is disclosed in U.S. Pat. No. 5,348,241, entitled "Romex Wire Dispenser," which issued in Sep. 20, 1994 to Huette. Instead of a table, as in the Bourhenne '597 patent, several horizontally-extending radial arms are provided to define a similar rotating support member that is also connected with a single, vertically extending stud for supporting the wire spool for rotation about a vertical axis.

Another form of wire spool support is disclosed in U.S. Pat. No. 4,167,255, entitled "Electrician Stud Grip," which issued on Sep. 11, 1979, to Benson. A wire spool is carried on a platform that is suspended from an arm that extends outwardly from a supporting bracket that engages a single, vertically extending stud.

A further form of wire spool support is shown in U.S. Pat. No. 5,690,301, entitled "Stud Mounted Spool Support System," which issued on Nov. 25, 1997, to Shelton et al. the disclosed support also is supported from only a single vertical stud and includes a horizontally extending shaft for rotatably supporting a spool of wire.

Although the prior art shows several different forms of supports for supporting a spool of wire for easy uncoiling, the disclosed supports generally are designed for use on only a single stud. Thus, if resistance to uncoiling is encountered for some reason, pulling on the wire to force it to uncoil could impose an excessive torque on the single stud, possibly causing it to twist relative to the sill plate and the wall plate. In that regard, it is desirable to provide a more stable support arrangement whereby wire spools can be supported from a pair of vertically extending studs without imposing torque on the studs. It is also desirable to provide a support that can also be utilized to support other items, such as a board to serve as a temporary shelf for tools, or the like, or for supporting several boards to provide a work bench or a flat surface for construction drawings. It is also desirable that the support serve for supporting a plurality of spools of wire for rotation about either a horizontal axis or a vertical axis, to permit different types of wire to be conveniently uncoiled for use in a construction project.

It is therefore an object of the present invention to provide a more versatile support for supporting wire spools and the like above the floor in a construction environment.

It is another object of the present invention to provide a support that can be readily utilized both in connection with vertically extending studs defining a wall framing structure, as well as inclined upright members, such as the rails of a conventional A-frame step ladder.

It is a further object of the present invention to provide a support that is of simple construction, that is rugged, and that can be utilized to support a variety of items from pairs of adjacent, substantially upright members including wall studs and step ladders.

SUMMARY OF THE INVENTION

Briefly stated, in accordance with one aspect of the present invention, a support is provided that includes a pair of first and second, laterally spaced, substantially parallel crossbars. The crossbars have a length sufficient to enable each crossbar to extend between and to contact each of a pair of laterally spaced, substantially parallel, upwardly-extending members. A support arm extends transversely relative to the crossbars and is securely connected with each of the crossbars to define a rigid, unitary support. The support arm includes a connecting portion that extends between and interconnects the first and second crossbars to hold the crossbars in laterally-spaced, substantially parallel relationship. A support bar of the support arm extends away from the crossbars at an acute angle relative to a plane that passes through each of the crossbars. The support bar has a predetermined length to provide a substantially horizontal supporting surface for supporting an article on the supporting surface when the support is positioned between and is in contact with each of the upwardly-extending members.

BRIEF DESCRIPTION OF THE DRAWINGS

FIG. 26 is a fragmentary perspective view of a pair of supports in accordance with the present invention carried in laterally-spaced stud wall openings to provide support surfaces for a temporary shelf, a work table, a drawing table, or the like.

DESCRIPTION OF THE PREFERRED EMBODIMENTS

Figure 1:
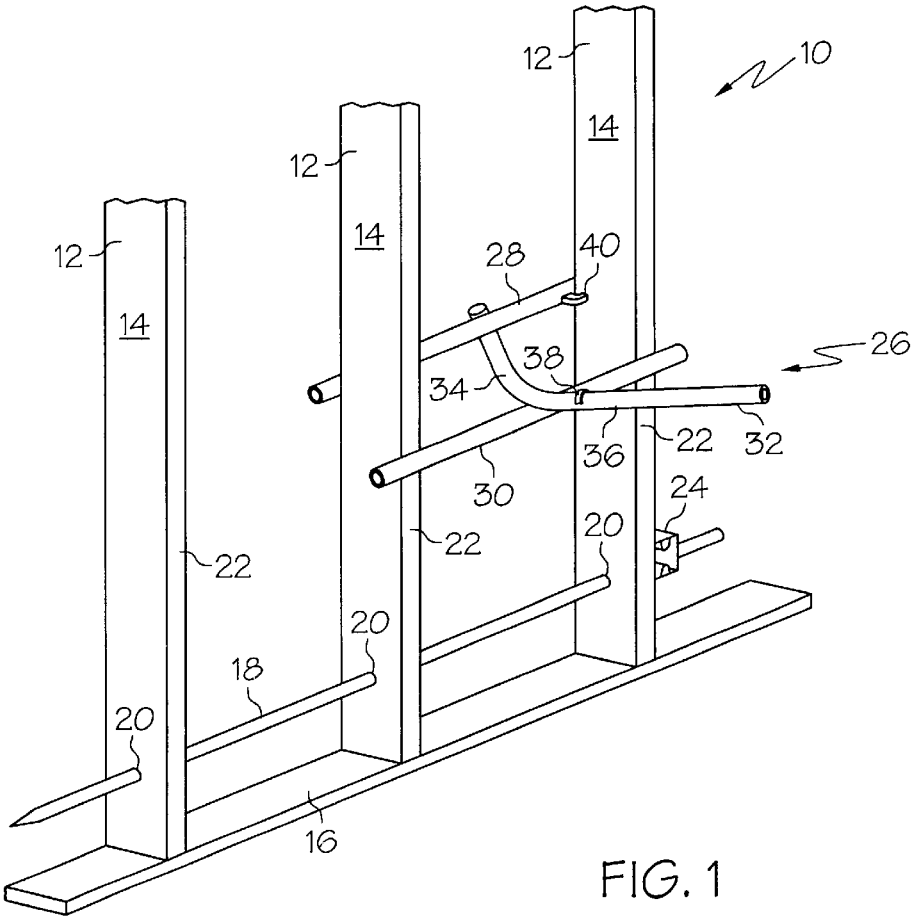
FIG. 1 is a fragmentary perspective view of a portion of a wood frame wall with a support in accordance with the present invention in operative position between a pair of adjacent studs.

Referring now to the drawings, and particularly to FIG. 1 thereof, there is shown a portion of a stud wall 10 including a plurality of vertically-extending, substantially parallel studs 12. The studs are laterally spaced from each other a predetermined distance and each major face 14 of a stud faces a major face 14 of an adjacent stud so that the respective major faces of the studs are in opposed, facing relationship. Studs 12 are nailed to a sill 16 at their lowermost ends and are connected to a wall plate (not shown) at their uppermost ends to define a rectangular frame for a wall.

Most often, interior walls of the type shown in FIG. 1 are formed from 2×4 lumber, wherein the studs are placed 16 inches on center. Sometimes the studs are placed 24 inches on center, and at other times the studs can be 2×6 lumber. Typically, electrical wiring 18 is threaded through the studs, through apertures 20 drilled therethrough, so that the electrical wiring is located entirely within the wall that is ultimately formed by nailing plasterboard or other sheeting material to the outwardly facing ends 22 of the studs. Some of the wire may connect with a wall outlet box 24 or to a junction box (not shown). In any event, the wire is normally provided in roll form on spools containing from 250 feet of wire to 1000 feet of wire. Such wire spools can weigh from about 60 to about 90 pounds, depending upon the wire size, type and number of conductors. For example, a 1000 feet spool of 12 gauge, two conductor wire with a ground conductor weighs 84 pounds. So that the wire can be uncoiled easily from a wire spool, the spool should be supported, with its axis disposed either horizontally or vertically, so that the spool can rotate freely, rather than have the spool merely resting on the floor, so that the wire can be conveniently withdrawn from the spool for threading through the apertures in the studs without the wire becoming twisted. Because of the presence on the floor in the work area at the building site of numerous other materials, including lumber, wall sheeting, ductwork, tools, and the like, there is little free floor space, and therefore it is desirable that the wire spools not rest on the floor, or even that they be carried by a spool carrier that rests on the floor and that occupies needed floor space.

Figure 1A:
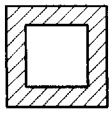
FIG. 1A is a cross-sectional view of one form of tubular bar from which the present invention can be constructed.
Figure 1B:
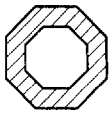
FIG. 1B is a cross-sectional view of another form of tubular bar from which the present invention can be constructed.

A wire spool support in accordance with the present invention, one that supports a wire spool above the floor and that enables wiring to be uncoiled from the spool without twisting, is shown in FIG. 1. Support 26 includes a pair of laterally-spaced, substantially parallel crossbars that include an upper crossbar 28 and a lower crossbar 30. Crossbars 28 and 30 can be in the form of solid members, such as metallic rods, but they can instead be formed from tubular members, if desired, in order to reduce the weight of support 26. Crossbars 28, 30 can be of any desired cross-sectional shape, including a circular shape as shown in FIG. 1, a rectangular shape as shown in FIG. 1A, a hexagonal shape as shown in FIG. 1B, or any other form of polygonal cross section.

Extending between and connected with each of crossbars 28, 30 at points substantially intermediate their respective outermost ends is a support member 32 that preferably extends substantially horizontally from lower crossbar 30 to support a variety of items, as will hereafter be explained. Support member 32 includes a connecting section 34 that is securely connected with each of the crossbars, such as by welding, or by any other means for providing a rigid and secure connection therebetween to prevent relative movement between connecting section 34 and crossbars 28, 30. Although shown as connected with the rearward facing surface of upper crossbar 28 and with the upwardly facing surface of lower crossbar 30, connecting section 34 can be connected with any intermediate area of either of the outer surfaces of the crossbars, although the connection positions as shown in the drawings impose less stress on the welds or other connections arrangements because the major effect of a downward load on support member 32 urges connecting section 34 against the respective crossbars, thereby imposing a compressive force at the connection points, rather than a tensile force. Extending outwardly from connecting section 34 is support section 36 on which wire spools, or the like, can be positioned, as will hereinafter be explained. The cross-sectional configuration of support member 32 can be the same cross-sectional form as that of crossbars 28, 30, or, if desired, it can be any of the other cross sections hereinbefore identified.

When support 26 is utilized in connection with a stud wall in which the studs are 2×4 lumber spaced 16 inches on center, the lengths of each of crossbars 28, 30 can be from about 18 inches to about 22 inches. For wall sections in which the studs are spaced 24 inches on center the lengths of each of the crossbars can be from about 26 inches to about 30 inches. Additionally, for 2×4-based wall sections the center-to-center spacing of the crossbars can be from about 4½ inches to about 8½ inches, depending upon the cross-sectional size of the cross members. For example, for a support 26 formed from tubular steel crossbars having a circular cross sectional and having an outer diameter of 1¼ inches, the spacing between the longitudinal axes of the crossbars when intended for use with a 2×4 stud wall is about 7¼ inches. For a 2×6 stud wall section the spacing between the longitudinal axes of the crossbars can be from about 6½ inches to about 10½ inches, depending, again, upon the cross-sectional size of the cross members.

The length of support section 36 of support arm 32 can be any convenient length for the particular purpose for which the support is to be utilized. For example, for use with 1000 foot rolls of electrical wiring, which generally have an axial length of from about 12 to about 15 inches, the length of support section 36 can be about 20 inches to support a single such spool.

As also shown in FIG. 1, support section 36 preferably includes a stop surface 38 provided thereon to provide a stop and thereby limit longitudinal movements of articles along the support section toward the crossbars. Stop surface 38 can be a ring-like structure that surrounds support section 36, or, alternatively, it can be a projection that only partially surrounds support section 36 (see FIG. 2) but that extends outwardly therefrom a sufficient distance to engage a portion of the end face of a wire spool to space the spool end face outwardly of lower crossbar 30. Additionally, stop surface 38 can include a friction-reducing radially-extending surface to reduce the friction that results when a spool of wire rotates on support arm 36 while the end face of the spool is in contact with stop surface 38. The low-friction surface can be provided by a smooth, machined radial surface or, alternatively, by a radial surface coated with a low-friction material, such as Teflon, or the like.

Figure 2:
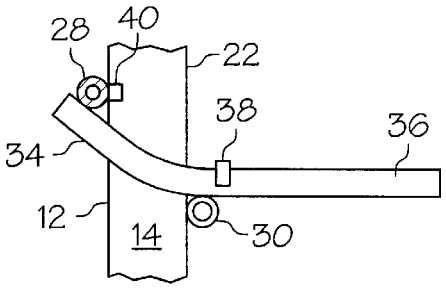
FIG. 2 is a fragmentary side elevational view of the support shown in FIG. 1.
Figure 3:
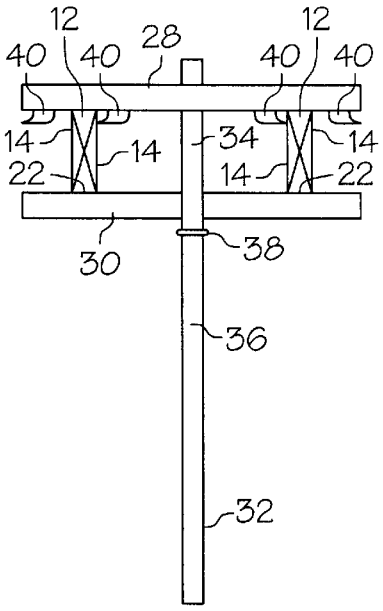
FIG. 3 is a top view of the support shown in FIG. 1.

Support 26 also preferably carries a pair of gripping members 40 that are provided on at least one of the crossbars, only one of which gripping members is visible in FIGS. 1 and 2. The structure of gripping members 40 will be described in more detail hereinafter. They are provided for the purpose of engaging the opposed facing surfaces 14 of two adjacent studs to maintain support 26 in a fixed vertical position along the studs. In FIG. 3, gripping members 40 are carried by rearmost crossbar 28, which, as shown, includes four gripping members. The two innermost gripping members are for use when support 26 is positioned between studs that are on 16 inch centers, and the two outermost gripping members are so positioned as to be in engagement with the opposed faces of adjacent studs that are on 24 inch centers.

Figure 5:
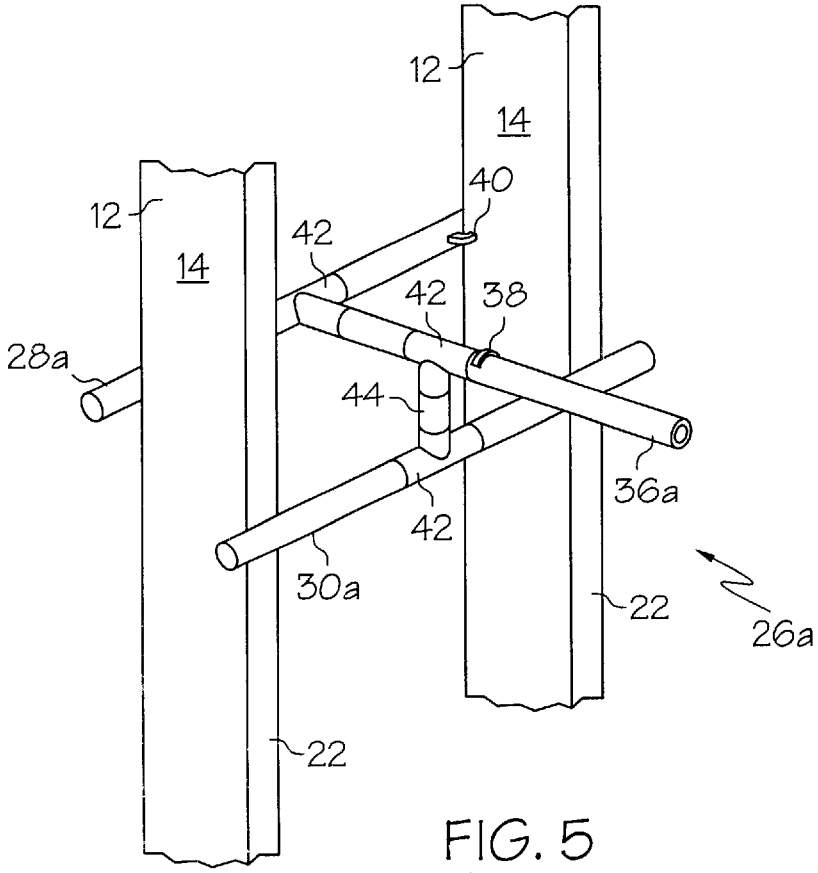
FIG. 5 is a fragmentary perspective view showing another embodiment of a support in accordance with present invention.
Figure 6:
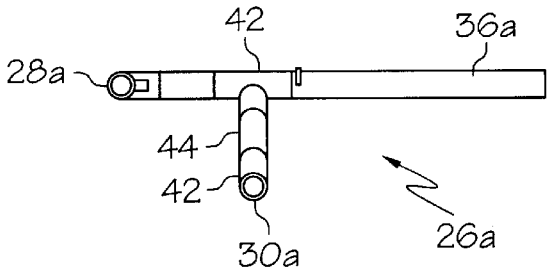
FIG. 6 is a side elevational view of the support shown in FIG. 4.
Figure 7:
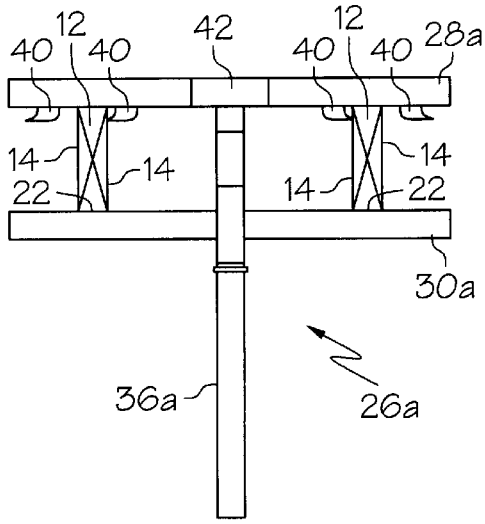
FIG. 7 is a top plan view of the support shown in FIG. 4.

An alternate embodiment of a support 26*a* in accordance with the present invention is shown in FIGS. 5 through 7. The alternate embodiment can be formed from steel tubing, such as one-inch steel tubing, and can be assembled using several tee-fittings 42 that interconnect several rectilinear tubes to form support 26*a*. Each of crossbars 28*a*, 30*a* is defined by a pair of tube members that are interconnected by a tee-fitting 42. The rearmost crossbar 28*a* is connected with support arm 36*a* that is defined by a pair of rectilinear sections that are connected together by a tee fitting 42. The connections between the parts of support 26*a* can be threaded connections or they can be welded connections. Lower crossbar 30*a* is similarly configured and is connected with support arm 36*a* through an intermediate tube 44 that is connected at each end with a tee-fitting 42, one of which forms a part of lowermost crossbar 30*a* and the other of which forms a part of support arm 36*a*. The alternate embodiment also includes a stop surface 38 and gripping members 40 that are carried by upper cross member 28*a*.

Figure 4:
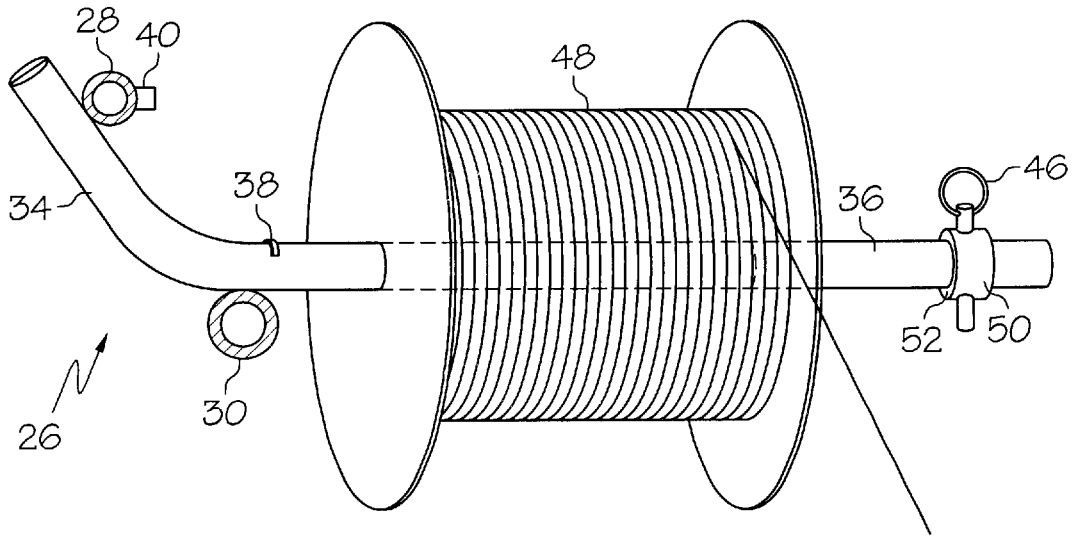
FIG. 4 side elevational view of the support shown on FIG. 1, partially in section, showing a spool of electrical wire carried by the support.

As shown in FIG. 4, support arm 26 can include at a point spaced longitudinally outwardly of stop surface 38 a transverse, diametrical throughbore for receiving a retaining pin 46 for limiting outward axial movement of wire spool 48 along support arm 36. If desired, a tubular stop collar 50, also having a transverse diametrical throughbore, can also be provided to define an outer stop surface 52. Retaining pin 46 can be any convenient type of retainer, such as a clevis pin, a ball-type positive lock pin, or the like, as will be appreciated by those skilled in the art.

Figure 8:
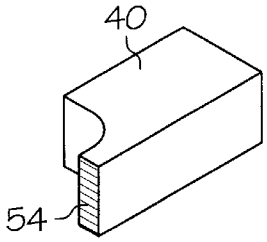
FIG. 8 is an enlarged, perspective view of one form of gripping member forming part of a support in accordance with the present invention.
Figure 9:
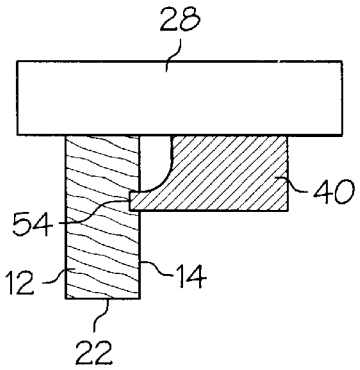
FIG. 9 is a fragmentary top view of the gripping member shown in FIG. 8 in position on a crossbar in engagement with a stud.
Figure 10:
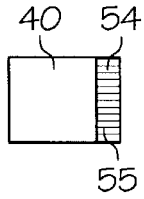
FIG. 10 is an end view of the gripping member shown in FIG. 8.

One form of gripping member 40 for securing support 26 in a desired position along a pair of laterally-spaced studs is shown in FIGS. 8 through 10. Gripping member 40 includes a gripping edge surface 54 that faces in a generally axially outward direction, relative to the longitudinal axis of crossbar 28. The two gripping members 40 carried by upper crossbar 28 (only one of which is shown in FIG. 9) have respective gripping edge surfaces 54 that face in opposite directions, so that they can be forced into tight surface contact with opposed faces 14 of a pair of adjacent studs 12. FIG. 9 shows one gripping member 40 in firm surface contact with face 14, and the opposite gripping member (not shown) is in similar firm surface engagement with face 14 of adjacent stud 12, which would be the mirror image of the elements as they are shown in FIG. 9.

Gripping edge surfaces 54 can be in a roughened form, such as the alternating, horizontally-extending ridges and grooves 55 shown in FIG. 10, to ensure that frictional contact of the faces of the respective studs by gripping members 40 occurs. The side-to-side spacing between the respective gripping edge surfaces 54 carried by crossbar 28 can be from about 14¾ inches to about 15½ inches, when support 26 is to be utilized in connection with 2×4 studs that are 16 inches on center, and from about 22¾ inches to about 23½ inches, for 2×4 studs that are 24 inches on center. Gripping members 40 can be securely attached to crossbar 28, such as by welding or the like, or they can be made to be adjustable laterally, if desired.

Figure 11:
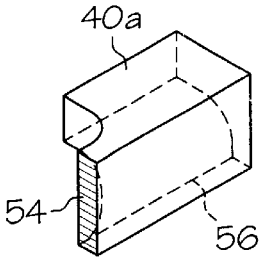
FIG. 11 is an enlarged, perspective view of an alternate form of gripping member forming part of a support in accordance with the present invention.
Figure 12:
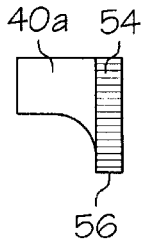
FIG. 12 is an end view of the gripping member shown in FIG. 11.
Figure 13:
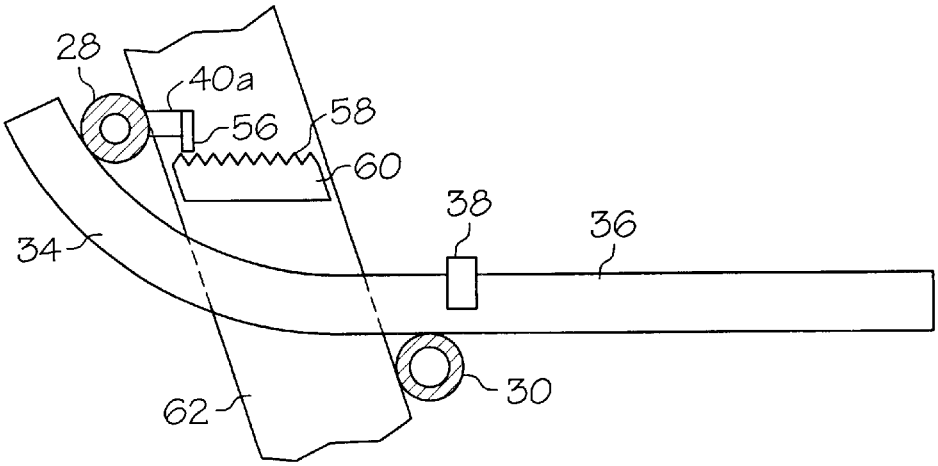
FIG. 13 is a fragmentary, side elevational view, partially in section, showing a support in accordance with the present invention in operative position on an A-frame stepladder.

An alternate form of gripping member is shown in FIGS. 11 through 13, in which gripping member 40*a* has an overall shape similar to that of gripping member 40 shown in FIGS. 8 through 10. However, gripping edge member 40*a* includes two gripping edge surfaces, an outwardly facing gripping edge surface 54, similar in form and orientation to that shown in FIGS. 8 and 10, and also a second gripping edge surface 56 that extends in a longitudinal direction, relative to the longitudinal axis of crossbar 28, so that second gripping edge surface 56 is substantially perpendicular to gripping edge surface 54. Second gripping edge surface 56 is provided for frictionally engaging the upwardly facing surface 58 of a step 60 of an A-frame stepladder, only one of the inclined side rails 62 of which is shown in FIG. 13.

Figure 14:
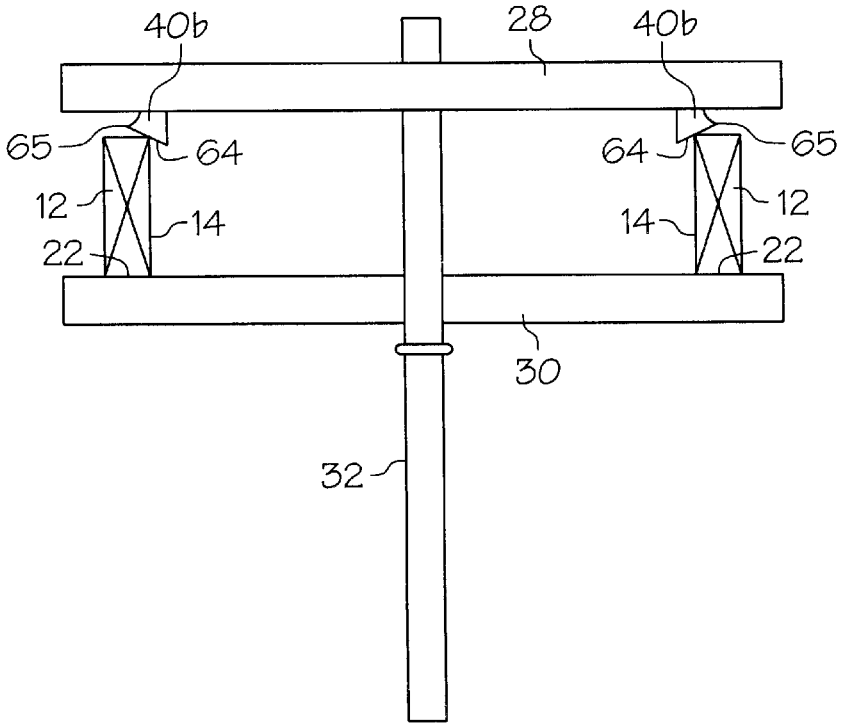
FIG. 14 is a top plan view of a support in accordance with the present invention having alternate form of gripping member.

A still further embodiment of a gripping member that can be utilized with a support in accordance with the present invention is shown in top plan view in FIG. 14. As shown, gripping members 40*b* each include wedge surfaces 64 that are each inclined both with respect to the longitudinal axis of crossbar 28 as well as with respect to the longitudinal axis of support arm 32. The outermost edges 65 of gripping members 40*b* can be sharp, linear edges, as shown in FIG. 14, or they can be substantially planar surfaces (not shown) that are serrated or ridged similar to griping edge surfaces 54 as shown in FIGS. 8 and 10. A support that includes gripping members configured as shown in FIG. 14 can be simply and easily installed in operative position in a stud wall by positioning the support as shown and pressing on support member 32 in a downward direction to cause wedge surfaces 64 to spread apart adjacent studs 12 until outermost edges 65 engage respective opposed stud faces 14 to frictionally grip the studs and hold the support in the desired position relative to the stud wall.

Figure 15:
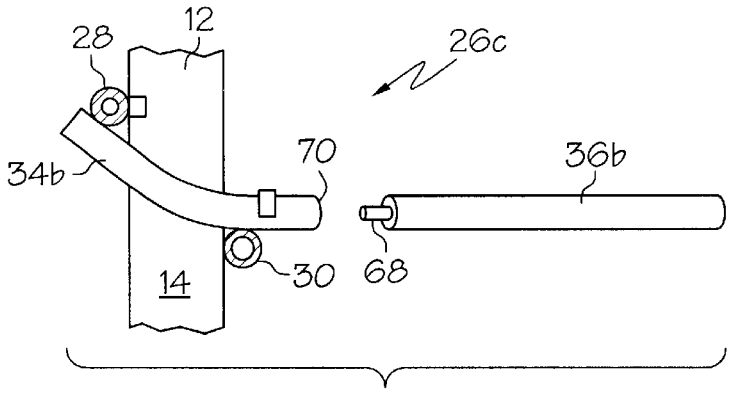
FIG. 15 is a fragmentary, side elevational view, partially in section, showing the support shown in FIG. 1 including a removable support section.
Figure 16:
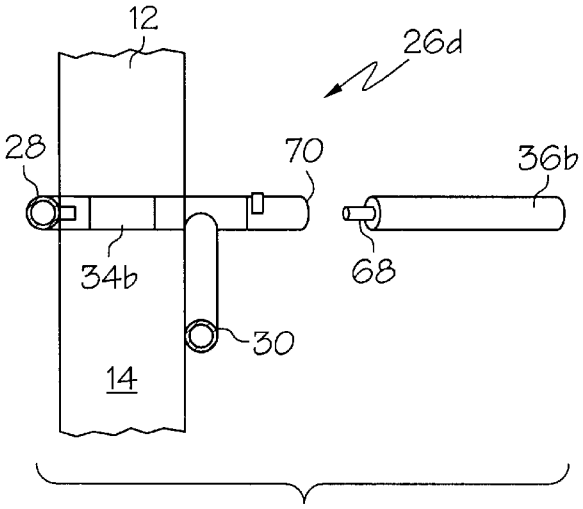
FIG. 16 is a fragmentary side elevational view, partially in section, of the support shown in FIG. 5 including a removable support section.

Referring now to FIGS. 15 and 16, there are shown supports 26*c* and 26*d*, respectively, wherein support section 36*b* of the support arm is detachable from connecting section 34*b* of the support arm. Support section 36*b* can include a reduced diameter end 68 that is slidably received within an open end 70 of connecting section 34*b*. Alternatively, support section 36*b* and connecting section 34*b* can be interconnected by means of a threaded connection, if desired. Removable support section 36*b* is shown in FIG. 15 in connection with support 26*c* that has a structure and an overall configuration similar to that of support 26 shown in FIG. 1, and it is shown in FIG. 16 in connection with support 26*d* that has a structure and an overall configuration similar to that of support 26 shown in FIG. 4.

Thus far the support has been described in the context of a support section 36 that defines a generally horizontally disposed rotation axis for a spool of wire. If it is desired that the wire spool be so positioned that its axis of rotation extends in a vertical direction, an attachment or adapter 72 such as that shown in FIG. 17 can be employed. Adapter 72 includes a cylindrical member 73 that can be either solid or tubular, and that includes a saddle-type, or U-shaped end 74 that is welded to a tubular sleeve 75. Sleeve 75 is adapted to slide along the outer surface of support section 36. Adapter 72 includes a pair of diametrical throughbores 78 (only one of which is visible in FIG. 17) that align with corresponding apertures (not shown) in support section 36. The apertures are adapted to receive a retaining member, such as retaining pin 80. The uppermost end 82 of adapter 72 can include a transverse, diametrical throughbore 84 to receive a suitable retaining member, such retaining ring 86 that can be held in position by a suitable retaining pin 88 to limit upward axial movement of a wire spool along adapter 72. Retaining pins 80 and 88 can be clevis pins, ball-type positive lock pins, or the like, as will be appreciated by those skilled in the art.

Figure 18:
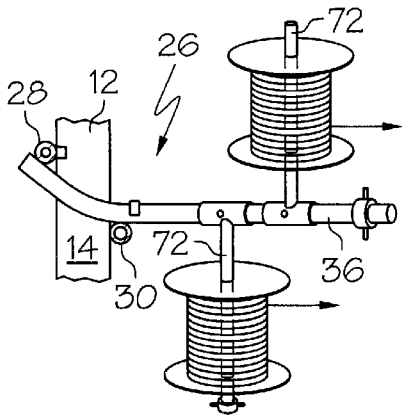
FIG. 18 is a fragmentary side elevational view, partially in section, showing a pair of vertical axis attachments in operative position on a support in accordance with present invention.

FIG. 18 shows support 26 with a pair of horizontally-spaced vertical adapters 72 for supporting a plurality of rolls of wire for rotation about respective vertical axes. One adapter 72 extends upwardly from support section 36 while the other extends downwardly therefrom.

Figure 19:
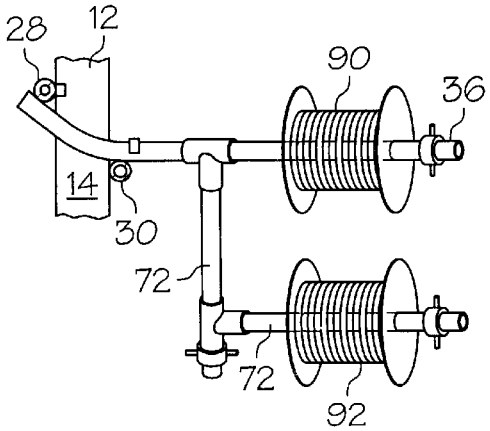
FIG. 19 is a fragmentary, side elevational view of a support including a parallel horizontal axis attachment.

FIG. 19 shows support 26 with a pair of angular-disposed adapters 72 for enabling two wire spools 90, 92 to be supported in vertically spaced relationship for rotation about respective horizontal axes of rotation. Spool 90 is rotatably supported by support arm 36. Spool 92 is rotatably supported by an L-shaped support member that hangs from support arm 36. Vertically-extending adapter 72 has attached to it, such as by retaining pins or the like, a horizontally-extending adapter 72 to define the L-shaped support member that supports spool 92. Horizontally-extending adapter 72 can be connected to vertically-extending adapter 72 by a suitable pinned connection.

Figure 20:
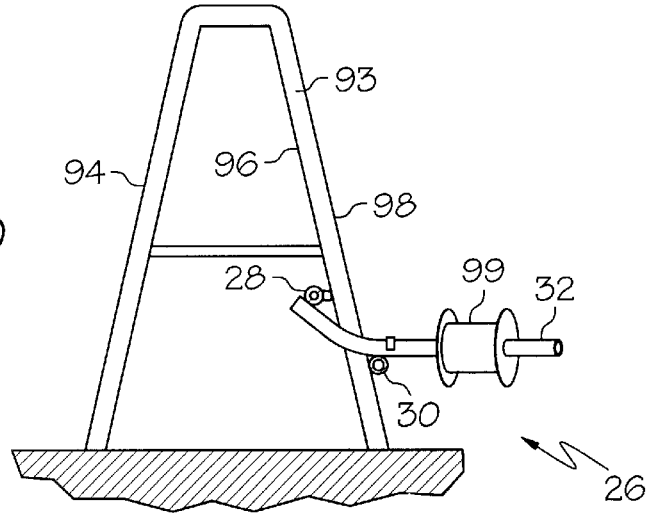
FIG. 20 is a side elevational view showing a support in accordance with the present invention in operative position on an A-frame stepladder and supporting a spool of wire.
Figure 21:
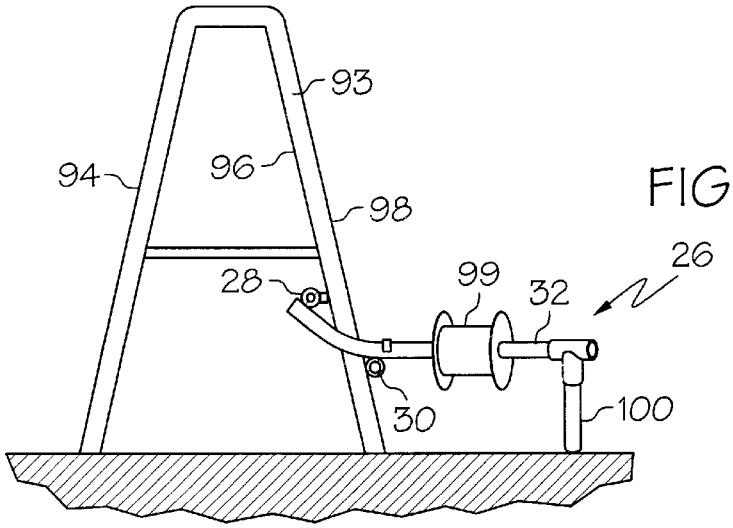
FIG. 21 is a side elevational view similar to that of FIG. 20, showing the support with a vertical stabilizing member.
Figure 22:
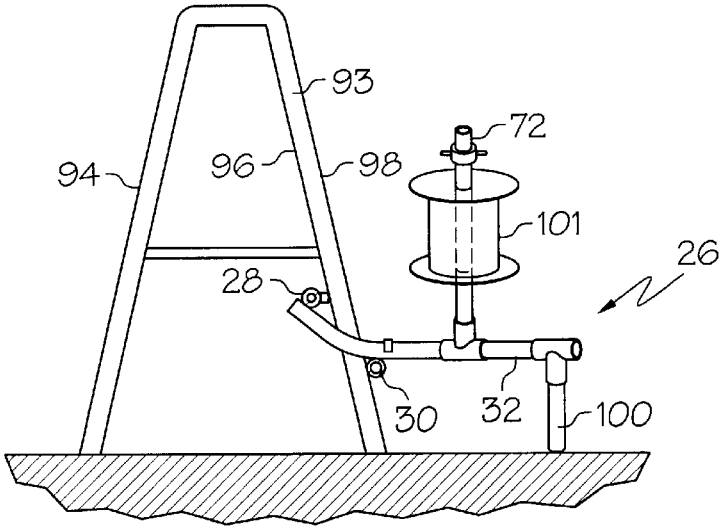
FIG. 22 is a side elevational view similar to that of FIG. 21 and showing the support with a vertical axis attachment supporting a spool of wire, along with a vertical stabilizing member.

In addition to its use to support wire spools from a stud wall that is defined by a plurality of spaced, substantially parallel, vertically-extending studs, a support in accordance with the present invention can also be utilized on upwardly-extending members that are not precisely vertical, but that are inclined to the vertical at an acute angle. Examples of such inclined, upwardly-extending members are the step-supporting rails 93 of an A-frame stepladder 94, as shown in FIGS. 20 through 22. In FIG. 20 support 26 is positioned between two adjacent horizontal steps (not shown) of ladder 94, so that upper crossbar 28 engages the inwardly facing edges 96 of ladder rails 93, while lower crossbar 30 engages the outwardly-facing edges 98 of the ladder rails. In FIG. 20 a wire spool is supported for rotation about a generally horizontal axis of rotation. And although a single, large wire spool is shown in FIG. 20, multiple smaller spools can be supported from the stepladder in side-by-side relationship, if desired.

FIG. 21 is similar to FIG. 20 but shows support 26 with an outboard support stabilizer 100 for supporting a heavy wire spool and to prevent tipping over of stepladder 94 as a consequence of the weight of wire spool 99. Stabilizer 100 can have the structure of adapter 72 shown in FIG. 17.

Figure 17:
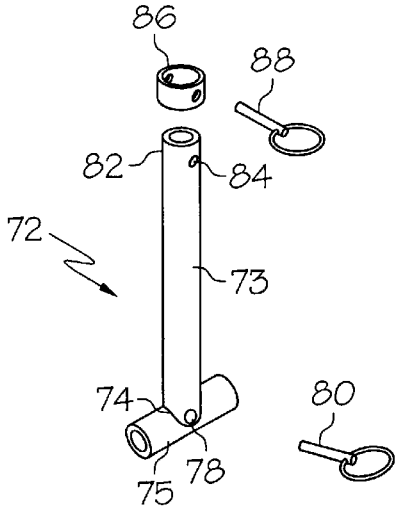
FIG. 17 is an exploded perspective view showing a vertical axis attachment for use with a support in accordance with the present invention.

FIG. 22 shows support 26 with an outboard support stabilizer 100 and also with a vertical axis adapter 72 of the type shown in FIG. 17, to enable wire spool 101 to be positioned with its axis of rotation extending vertically.

Figure 23:
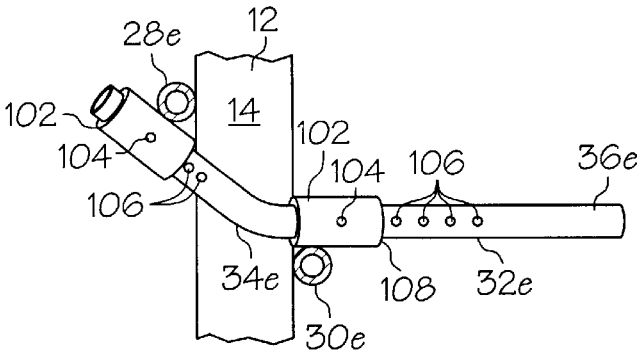
FIG. 23 is a fragmentary, side elevational view, partially in section, of a support of the type shown in FIG. 1 that is adjustable to enable use of the support on walls framed with different size studs.

In addition to a support 26 as shown in FIG. 1, in which crossbars 28 and 30 are each securely affixed to connecting section 34, the device can also be made to be adjustable so it can be adapted for use either on 2×4 wall studs, on 2×6 wall studs, or on upwardly-extending structural members of other sizes. FIG. 23 shows a support 26*e* that is structurally similar to support 26 shown in FIG. 1 in that it includes upper crossbar 28*e*, lower crossbar 30*e*, and support arm 32*e* defined by connecting section 34*e* and support section 36*e*. However, the spacing between crossbars 28*e* and 30*e* can be changed by sliding crossbar 30*e* along support arm 32*e* toward or away from crossbar 28*e*. Alternatively, that spacing can be changed by sliding crossbar 28*e* along connecting section 34*e* toward or away from crossbar 30*e*.

In the FIG. 23 embodiment either or both of the crossbars can be made to be movable along support arm 32*e* by attachment to either or both crossbars of a tubular sleeve 102. Sleeve 102 includes a transverse, diametrical throughbore 104 that can be positioned along support arm 32*e* so that throughbore 104 can be aligned with cooperating throughbores 106 provided in support arm 32*e* and in connecting section 34*e*, and so that the particular crossbar can retained in the desired position along support arm 32*e* by suitable retaining pins (not shown) or the like. Thus, the positions of crossbars 28*e* and 30*e* can be adjusted relative to each other in such a way that support arm 32*e* can be made to extend substantially horizontally, regardless of the front-to-back dimension of stud 12. Further, as shown in FIG. 23, the longitudinal axes of sleeves 102 are oriented to be perpendicular to the longitudinal axes of the respective crossbars 28*e* and 30*e*, and the outwardly-facing end surface 108 of sleeve 102 attached to crossbar 30*e* can function as a stop surface, similar to stop surface 38 shown in FIG. 2.

Figure 24:
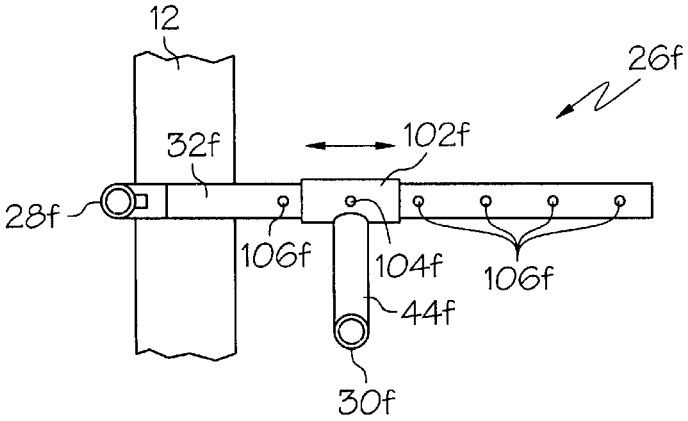
FIG. 24 is a fragmentary, side elevational view, partially in section, of a support of the type shown in FIG. 5 that is adjustable to enable use of the support on walls framed with different size studs.

FIG. 24 shows another adjustable support 26*f*, one that is structurally similar to support 26*a* shown in FIG. 5. Support 26*f* can also be adjusted for use with differently-sized studs 12 and includes crossbar 28*f* that is in fixed, perpendicular relationship relative to support arm 32*f* Crossbar 30*f* is connected with intermediate tubular member 44*f* and is in perpendicular relationship therewith. Tubular member 44*f* carries a tubular sleeve 102*f* that is structurally similar to sleeve 102 shown in FIG. 23. The longitudinal axis of sleeve 102*f* is perpendicular to the longitudinal axis of crossbar 30*f* so that crossbar 30*f* can be slidably positioned along support arm 32*f* at a desired position by a similar pinned connection to that shown in FIG. 23, by means of a suitable retaining pin (not shown) that extends through diametrical throughbore 104*f* in sleeve 102*f* and one of diametrical throughbores 106*f* in support arm 32*f*.

Figure 25:
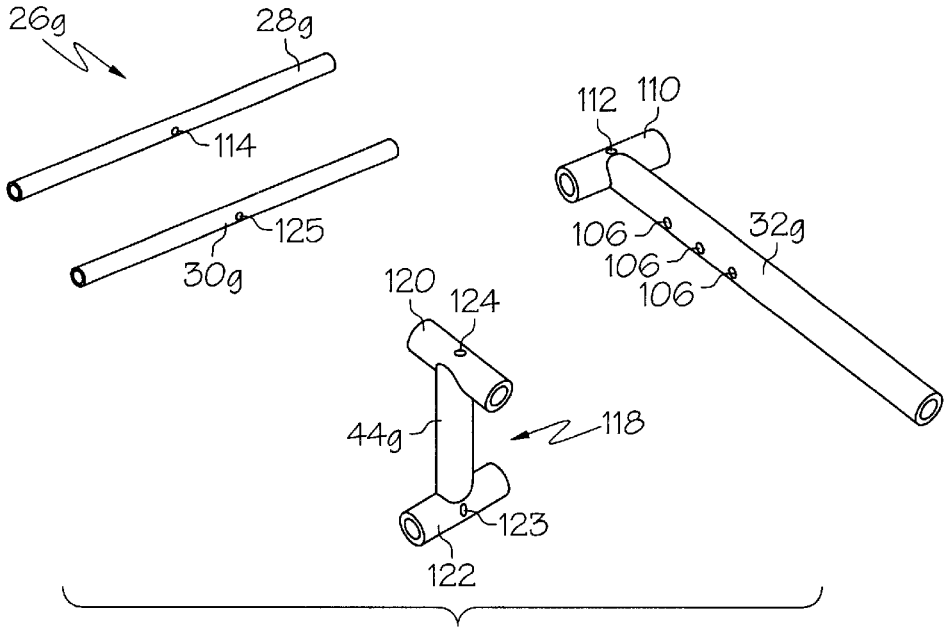
FIG. 25 is an exploded view of the parts of a support in accordance with the present invention that can be disassembled for convenient carrying between job sites and later reassembled for use at the new job site.

FIG. 25 shows in spaced relationship the parts of a further variant of the present invention in which the support can be provided in separable parts that can be disassembled for convenient storage or for convenient transit to a different work site, at which they can be quickly reassembled for use. Support 26*g* includes upper crossbar 28*g* and lower crossbar 30*g*. Support arm 32*g* includes a perpendicularly-extending tubular sleeve 110 including a diametrically-extending throughbore 112 for alignment with diametrical throughbore 114 provided in crossbar 28*g*, to enable those parts to be interconnected by a suitable retaining pin (not shown). Support arm 32*g* also includes diametrical throughbores 116.

Lower crossbar 30*g* is connected with support arm 32*g* by connector 118 that includes an intermediate tube 44*g* to each end of which is attached, such as by welding, a tubular sleeve 120, 122, each of which sleeves includes a diametrical throughbore 124, 123, respectively. The longitudinal axes of each of sleeves 120, 122 are oriented to be perpendicular to the longitudinal axis of intermediate tube 44*g*, and the longitudinal axes of the sleeves are oriented at right angles to each other. Throughbore 123 in sleeve 122 is aligned with throughbore 125 in crossbar 30*g* and the two parts are held together by a suitable retaining pin (not shown). Similarly, throughbore 124 in sleeve 120 is aligned with one of throughbores 116 in support arm 32*g*, also be a suitable retaining pin (not shown). When in assembled form support 26*g* has an appearance that corresponds substantially with the appearance of support 26*a* shown in FIG. 5.

Figure 26:
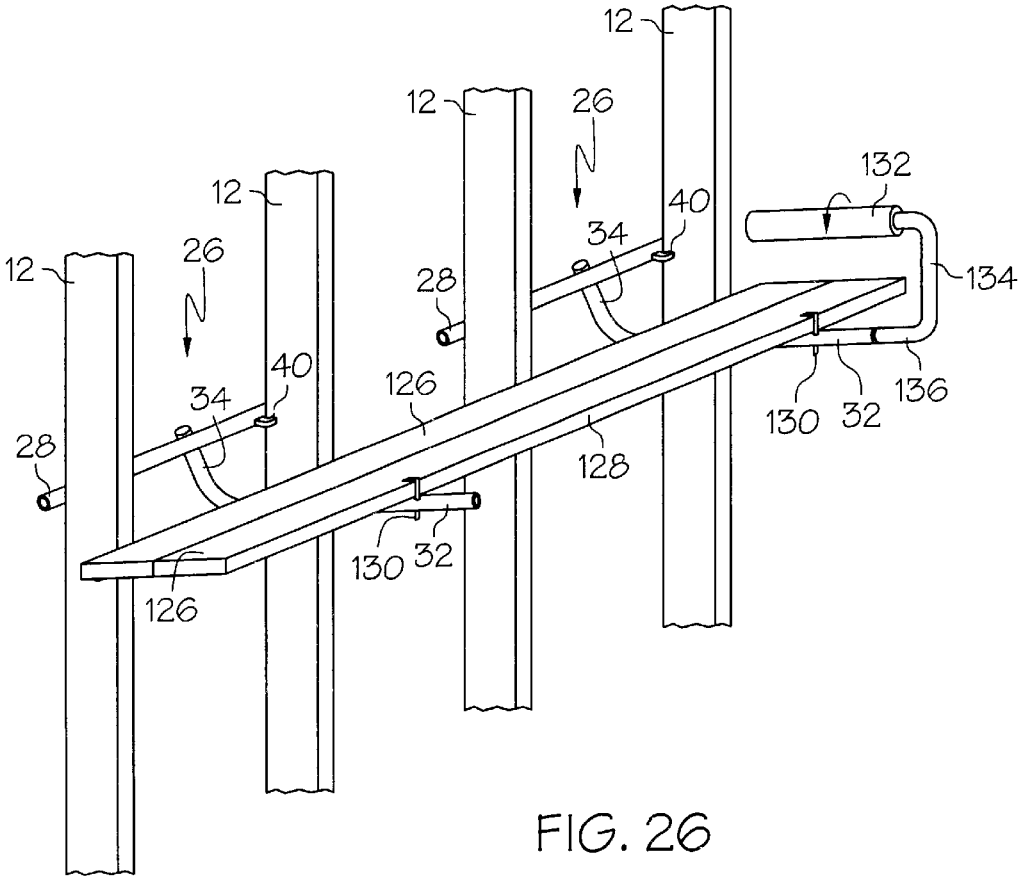

In addition to the suitability of a support in accordance with the present invention serving to carry wire spools, the support can also serve other functions at a construction site. For example, as shown in FIG. 26, a pair of supports can be positioned in side-by-side relationship while retained by respective laterally spaced pairs of adjacent studs, wherein a pair of supports 26 having the configuration shown in FIG. 3 are supported by respective studs 12 so that support arms 32 are at substantially the same height above the floor. One or more boards 126, or a single flat panel (not shown) can be placed on support arms 32 to provide a shelf, a workbench, a utility table, or a surface for examining construction drawings, or the like. The innermost of boards 126 has an inwardly-facing edge that faces studs 12 and that abuts a stop surface (not shown), and the outermost of boards 126 has an outwardly-facing edge 128 that abuts each of a pair of L-shaped retaining pins 130 that pass through respective diametrical throughbores provided in each of support arms 32. Additionally, an exit roller 132 for a saw (not shown) can be rotatably supported by a U-shaped support member 134 that has a leg 136 that extends into the outermost end of and that is retained by one of support arms 32.

Figure 27:
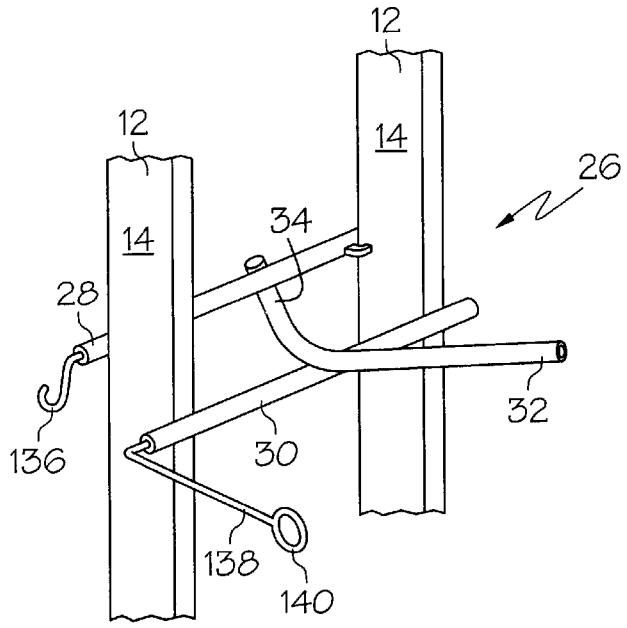
FIG. 27 is a fragmentary perspective view of one form of support in accordance with the present invention showing several different types of convenience attachments that can be provided and utilized with the support.
Figure 28:
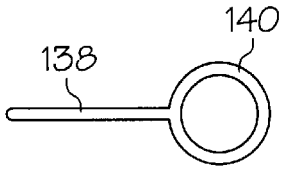
FIG. 28 is an enlarged fragmentary view of one form of wire guide for use with a support in accordance with the present invention.

Other accessories that can be provided for use with a support 26 are shown in FIGS. 27 through 30. In FIG. 27 one or more accessory hooks 136 can be retained in an end of one of crossbars 28 and 30 for holding a work light, a coiled extension cord, or for hanging tools or other items. One of crossbars 28 or 20 also can receive a wire guide 138 for guiding wire as it is uncoiled from a spool. Wire guide 136 can include a loop end 140, as shown in FIG. 28, or a roller end 142 that includes a roller cage 144 that carries one or more pairs of parallel rollers 146 to reduce the drag force on the wire as the wire passes through the wire guide during uncoiling and feeding of the wire.

Figure 30:
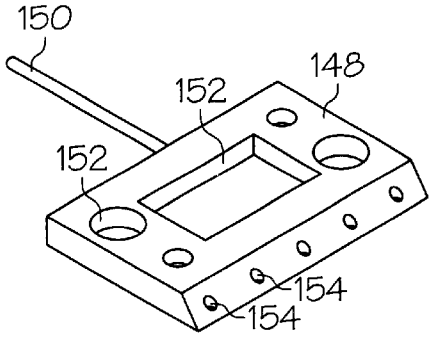
FIG. 30 is a perspective view of one form of tool tray that can be utilized with a support in accordance with the present invention.
Figure 29:
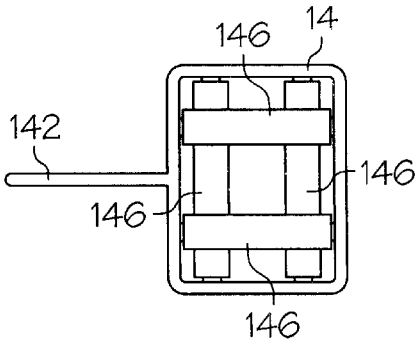
FIG. 29 is an enlarged fragmentary view of another form of wire guide for use with a support in accordance with the present invention.

Another accessory that can be carried in an end of one or more of crossbars 28, 30 is a tray 148 as shown in FIG. 30. Tray 148 is carried on a cylindrical arm 150 that can be received within an open end of a crossbar. Tray 148 can include one or more recesses 152 for small items such as fasteners, including nails, screws, wire staples, and the like, and one or more openings 154 for receiving and supporting hand tools, such as screwdrivers, pliers, wire cutters, and the like.

To install the support in its operative position, the support is held by support arm 32 and is manipulated so that the ends of each of the first and second crossbars 28, 30 are opposite the front and rear sides of a stud, as shown in FIG. 1. The support can be secured in position between a pair of adjacent studs by tilting it so that each of the crossbars is at an acute angle relative to a horizontal plane, and so that the edge surfaces of the gripping members 40 carried by the rear crossbar face the respective opposed side faces 14 of the studs. One of gripping members 40 is then brought into contact with the adjacent stud surface at the desired height from the floor, and the support is then tilted back toward the horizontal plane until the opposite gripping member 40 is in contact with the surface of the opposite stud face 14.

Because the surface-to-surface spacing between the gripping edge surfaces 54 of the gripping members is greater than the face-to-face spacing of adjacent studs, the crossbars cannot be brought to a horizontal position without pressing downwardly on the uppermost crossbar until it digs into the adjacent stud at a substantially horizontal position. Each of the gripping edge surfaces 54 bears against a face 14 of an adjacent stud, as a result of which gripping members 40 push the respective studs outwardly relative to each other a slight distance as the support is moved into a horizontal position, thereby providing a secure interference fit between the gripping members and the opposed stud faces, to maintain the support in its desired position on the stud wall relative to the floor. Once it is in its operative position, a wire spool can be slid onto the support arm and wire can be conveniently withdrawn therefrom, as shown in the drawings, or a second support can be installed next to the first support to permit boards or a panel to be placed on the support arms to provide a flat surface, as shown in FIG. 26.

Although particular embodiments of the present invention have been illustrated and described, it will be apparent to those skilled in the art that various changes and modifications can be made without departing from the spirit of the present invention. Accordingly, it is intended to encompass within the appended claims all such changes and modifications that fall within the scope of the present invention.

What is claimed is:

1. A support comprising:

a. a pair of first and second, laterally-spaced, substantially parallel crossbars each having a longitudinal axis and having a length sufficient to enable each crossbar to extend between and to contact each of a pair of laterally-spaced, substantially parallel, upwardly-extending members;

b. a support arm extending transversely relative to the crossbars and securely connected with each of the crossbars to define a rigid, unitary support, the support arm including a connecting portion that extends between and interconnects the first and second crossbars to hold the crossbars in laterally-spaced, substantially parallel relationship, and a support portion that extends away from the crossbars at an acute angle relative to a plane that passes through each of the crossbars, the support portion having a predetermined length to provide a substantially horizontal supporting surface for supporting an article on the supporting surface when the support is positioned between and is in contact with each of the upwardly-extending members.

2. The support in accordance with claim 1 wherein the crossbars are rectilinear.

3. The support in accordance with claim 1 wherein the crossbars are tubular.

4. The support in accordance with claim 3 wherein the crossbars have a substantially circular cross section.

5. The support in accordance with claim 3 wherein the crossbars have a polygonal cross section.

6. The support in accordance with claim 5 wherein the crossbars have a rectangular cross section.

7. The support in accordance with claim 1 wherein the spacing between the axes of the crossbars is from about 4½ in. to about 8½ in.

8. The support in accordance with claim 7 wherein the spacing between the axes of the crossbars is from about 6½ in. to about 10½ in.

9. The support in accordance with claim 1 wherein the connecting portion includes a first connecting leg extending from the first crossbar and a second connecting leg extending from the second crossbar, and wherein the first and second connecting legs are substantially perpendicular to each other.

10. The support in accordance with claim 1 wherein at least one of the first and second crossbars is movable along the connecting portion toward and away from the other of the first and second crossbars for changing the spacing between the axes of the first and second crossbars.

11. The support in accordance with claim 1, including at least one substantially vertical support member carried by the support arm.

12. The support in accordance with claim 1, wherein the upwardly-extending members are each inclined to the vertical at an acute angle.

13. The support in accordance with claim 1, wherein the support portion of the support arm is separable from the connecting portion.

14. The support in accordance with claim 13, wherein the support portion of the support arm and the connecting portion of the support arm are retained together by a pinned connection.

15. The support in accordance with claim 1 wherein the first crossbar is spaced from the support portion a greater distance than is the second crossbar, and the support arm includes a stop member adjacent the second crossbar to limit movement along the support arm of an article carried on the support arm.

16. The support in accordance with claim 1, wherein the first crossbar is spaced from the support portion a greater distance than is the second crossbar, and the first crossbar carries a pair of axially-spaced, outwardly-extending gripping members for engaging and gripping respective opposed surfaces of the upwardly-extending members.

17. The support in accordance with claim 16, wherein the gripping members include a rectilinear edge for engaging a surface of an upwardly-extending member to prevent relative movement between the support and the upwardly-extending member.

18. The support in accordance with claim 16 wherein the gripping members include an angular face adapted to engage respective edges of an upwardly-extending member to force the upwardly-extending members apart during installation of the support for retaining the support in a desired position along the upwardly-extending members.

19. A support in accordance with claim 18, wherein the gripping member includes a second gripping edge surface that is substantially perpendicular to the first gripping edge.

20. The support in accordance with claim 1, wherein the support portion includes at least two interengaged, coaxial support members that are interconnected with each other.

21. A support in accordance with claim 1, wherein the support portion includes a transverse throughbore for releasably receiving a retaining member for limiting outward axial movement of an article that is carried on the support portion.

22. The support in accordance with claim 1, wherein the crossbars are separable from the connecting portion and the connecting portion is separable from the support portion to enable the support to be conveniently transported.

* * * * *